US008109589B2

(12) United States Patent
Matsushita

(10) Patent No.: US 8,109,589 B2
(45) Date of Patent: Feb. 7, 2012

(54) LIQUID DISCHARGING DEVICE AND METHOD OF CONTROLLING THE SAME

(75) Inventor: Junichiro Matsushita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 319 days.

(21) Appl. No.: 12/578,032

(22) Filed: Oct. 13, 2009

(65) Prior Publication Data

US 2010/0091061 A1 Apr. 15, 2010

(30) Foreign Application Priority Data

Oct. 14, 2008 (JP) ..... 2008-264720

(51) Int. Cl.
*B41J 29/38* (2006.01)

(52) U.S. Cl. ..... 347/11

(58) Field of Classification Search ..... 347/9–11, 347/17, 19

See application file for complete search history.

(56) References Cited

U.S. PATENT DOCUMENTS

| | | | | |
|---|---|---|---|---|
| 5,851,075 | A * | 12/1998 | Imai | 400/120.14 |
| 7,438,376 | B2 * | 10/2008 | Tamura et al. | 347/17 |
| 7,918,521 | B2 * | 4/2011 | Furuya et al. | 347/10 |

FOREIGN PATENT DOCUMENTS

| | | |
|---|---|---|
| JP | 2001-096733 | 4/2001 |
| JP | 2003-182056 | 7/2003 |
| JP | 2004-299174 | 10/2004 |
| JP | 2005-205838 | 8/2005 |

* cited by examiner

*Primary Examiner* — An Do
(74) *Attorney, Agent, or Firm* — Workman Nydegger

(57) ABSTRACT

A liquid discharging device includes a liquid discharging head which discharges liquid. A drive signal generator generates a drive pulse. A liquid receiving portion faces a nozzle-formed surface of the liquid discharging head and receives discharged liquid. Electrical change information is acquired by detecting change in an electrical characteristic between a conductive portion of the liquid discharging head and the liquid receiving portion when liquid is discharged. Correlation information shows correlation between the electrical change information and temperatures of discharged liquid. The drive signal generator generates an information acquiring drive pulse. The correlation information shows correlation between the electrical change information obtained when discharging the liquid using the information acquiring drive pulse and the temperatures of the liquid. Based on the correlation information, the temperature of the liquid corresponding to the electrical change information is estimated as an estimated liquid temperature and the drive pulse is thereby corrected.

8 Claims, 6 Drawing Sheets

LIQUID DISCHARGING DEVICE AND METHOD OF CONTROLLING THE SAME

BACKGROUND

1. Technical Field

The present invention relates to a liquid discharging device, such as an ink jet printer, and a method of controlling the same, and more particularly to a liquid discharging device equipped with a liquid discharging head which discharges liquid from nozzle orifices by being driven by a discharge driver using a drive pulse and a method of controlling the liquid discharging device.

2. Related Art

For example, the liquid discharging device is equipped with a liquid discharging head which can discharge liquid and is a device for discharging various kinds of liquid from the liquid discharging head. A representative liquid discharging devices is an image recording device, such as an ink jet printer (hereinafter, referred to just as a printer), which is equipped with, for example, an ink jet recording head (hereinafter, referred to just as a recording head) serving as a liquid discharging head and records images by discharging ink in a liquid state from nozzle orifices of the recording head by driving a discharge driver of the recording head by a drive pulse toward a recording medium (discharge target) such as recording paper and hitting the recording medium with the ink. In recent years the liquid discharging device has been applied to various kinds of manufacturing devices such as a color filter manufacturing device, for example, of a liquid crystal display unit as well as the image recording device.

In the printer, if the temperature of ink varies according to the change of an ambient temperature (a temperature around a printer (an inside portion), and particularly the temperature at a region near a nozzle orifice), viscosity of the ink varies too. As a result, even if the drive pulse having the same waveform is used, the discharging behavior of the ink discharged from the nozzle orifice, for example, timing and speed of discharging, varies, so the image is not correctly printed on the recording medium. For such a reason, a technique of correcting the drive pulse according to the change of the ambient temperature is suggested. For example, JP-A-2001-096733 discloses a technique in which the temperature around a recording head (ambient temperature) is assumed as the temperature of ink and ink discharge timing is adjusted by correcting the drive pulse on the basis of the ambient temperature in order that misalignment between the actual hitting position of ink and the hitting target position of ink does not occur.

However, the above technique is not desirable because it needs to additionally use a temperature measuring unit to acquire the ink temperature information.

SUMMARY

An advantage of the invention is to provide a liquid discharging device which can estimate a temperature of liquid without using an additional temperature measuring unit and sufficiently suppress variation of a liquid temperature from influencing the discharge state of the liquid, and a method of controlling the same.

According to one aspect of the invention, there is provided a liquid discharging device including a liquid discharging head which discharges liquid from nozzle orifices by being driven by a discharge driver, a drive signal generator which generates a drive pulse for driving the discharge driver, a liquid receiving portion which is placed so as to face a nozzle-formed surface of the liquid discharging head and receives liquid discharged from the nozzle orifices, an electrical change detector which acquires electrical change information by detecting change in an electrical characteristic between a conductive portion of the liquid discharging head and the liquid receiving portion when liquid is discharged from the nozzle orifices to the liquid receiving portion in a state in which a voltage is applied between the conductive portion and the liquid receiving portion, and a correlation information storing portion which stores correlation information which shows correlation between the electrical change information and temperatures of liquid discharged from the nozzle orifices, in which the drive signal generator generates an information acquiring drive pulse used in electrical change information acquiring processing performed by the electrical change detector, in which the correlation information which shows correlation between the electrical change information obtained when discharging the liquid using the information acquiring drive pulse and the temperatures of the liquid is preliminarily stored in the correlation information storing portion, and in which, on the basis of the correlation information, the temperature of the liquid corresponding to the electrical change information obtained in the electrical change information acquiring processing is estimated as an estimated liquid temperature and the drive pulse is corrected according to the estimated liquid temperature. Further, the word "conductive portion" means a member which is conductive and has a portion in contact with liquid in the liquid discharging head.

According to such a structure, the temperature of the liquid corresponding to the electrical change information is estimated as the estimated liquid temperature on the basis of correlation between electrical change information obtained at the time of the discharging operation of the liquid and the temperature of the liquid and the drive pulse are corrected according to the estimated liquid temperature. Accordingly, it is possible to estimate the temperature of the liquid without using an additional temperature measuring unit. Further, it is possible to suppress degradation of the discharging precision in discharging the liquid attributable to the change of the temperature. It is possible to use the estimated liquid temperature which is estimated on the basis of information relating to the actual liquid temperature instead of the temperature of a part (for example, a nozzle orifice) around the liquid as the judging criteria for correction of the drive pulse. Accordingly, it is possible to correct the drive pulse to be suitable for the temperature of the liquid and sufficiently suppress the variation in the temperature of the liquid from influencing the discharge state of the liquid (for example, variation of the flight velocity of the liquid or variation of the discharge amount).

In the liquid discharging device, it is preferable that the drive pulse corrected according to the estimated liquid temperature is a discharge drive pulse used when discharging liquid to a discharge target other than the liquid receiving portion.

According to such a structure, the drive pulse corrected according to the estimated liquid temperature is used as a discharge drive pulse. Accordingly, it is possible to appropriately correct the state of the liquid (for example, misalignment of hitting positions of liquid on the discharge target, and the diameters of dots formed by hitting) discharged toward the discharge target regardless of the change in the temperature of the liquid.

In the liquid discharging device, it is preferable that the liquid discharging head moves in a reciprocating manner and discharges liquid in both forward and backward movements, and that the discharge timing of liquid is adjusted at least either in the forward movement or in the backward movement by correcting the drive timing of the discharge drive pulse according to the estimated liquid temperature.

According to such a structure, it is possible to adjust the timing of liquid discharge at least either in the forward movement or the backward movement of the liquid discharging head by correcting the drive timing of the discharge drive pulse according to the estimated liquid temperature. Accordingly, it is possible to harmonize the relative positional relationship between the hitting position of the liquid discharged in the forward movement and the hitting position of the liquid discharged in the backward movement with the predetermined setting even though the temperature of the liquid varies.

In the liquid discharging device, it is preferable that the electrical change detector serves as a discharge detector which checks the presence of the discharge of the liquid from the nozzle orifice by detecting electrical change between the conductive portion of the liquid discharging head and the liquid receiving portion when the liquid is discharged from the nozzle orifice to the liquid receiving portion in a state in which a voltage is applied between the conductive portion and the liquid receiving portion.

According to such a structure, it is possible to check whether discharging the liquid from the nozzle orifice is being performed by detecting the electrical change between the conductive portion and the liquid receiving portion when the liquid is discharged from the nozzle orifice toward the liquid receiving portion in the state of applying a voltage between the conductive portion of the liquid discharging head and the liquid receiving portion. Accordingly, it is possible to correct the discharge checking drive pulse according to the estimated liquid temperature. Therefore it is possible to suppress the occurrence of the problem that the accuracy in checking the discharging is lowered attributable to the variation of the liquid temperature.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for practicing the invention will be described with reference to the accompanying drawings. In the below-described embodiments, desirable examples of the invention will be suggested but the scope of the invention is not limited to such examples as long as there is no special description to limit the invention thereto. Further, in the following description, an ink jet printer (hereinafter, referred to as printer) shown in FIG. 1 is exemplified as the liquid discharging device of the invention.

Figure 1:
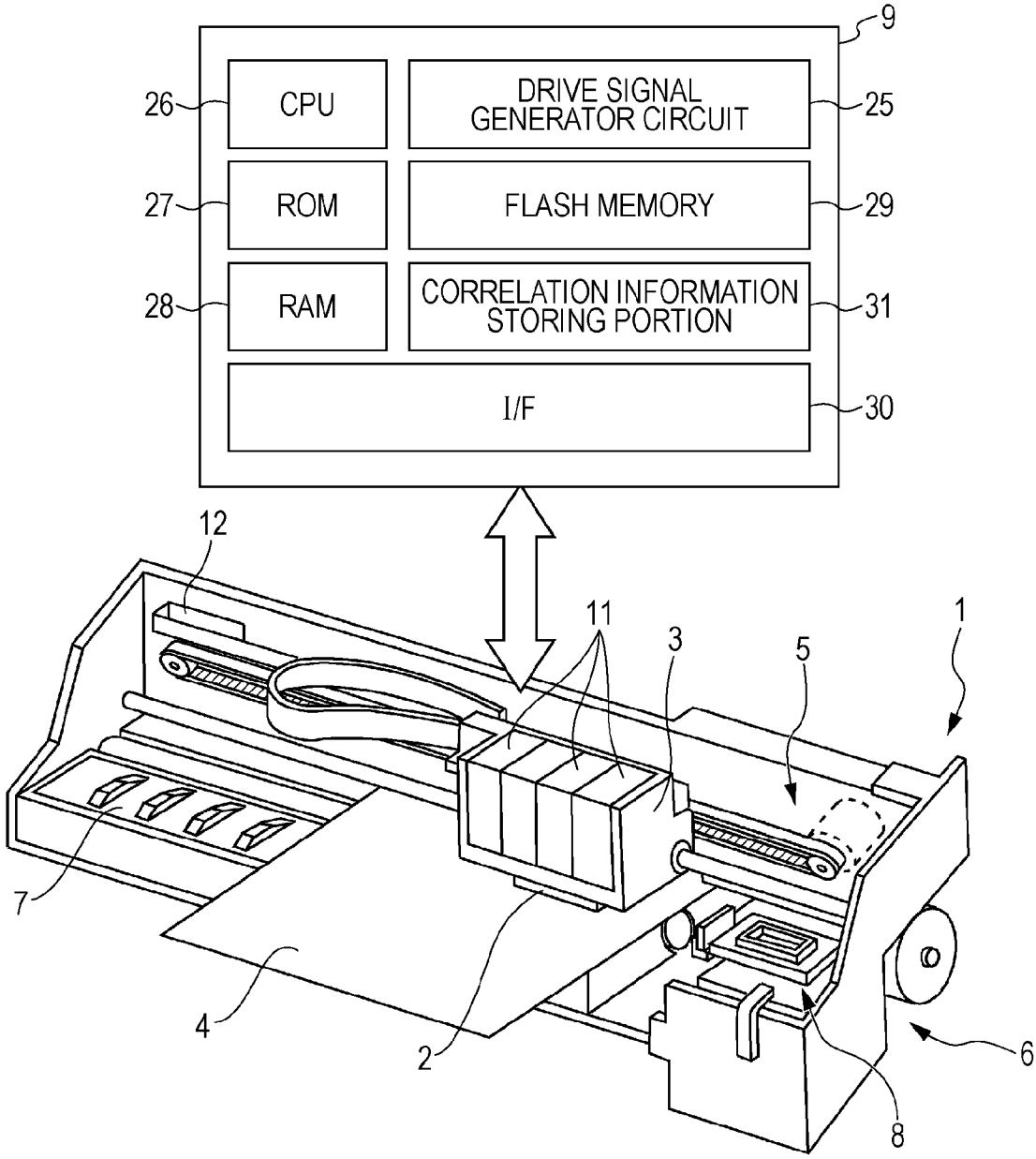
FIG. 1 is a block diagram and a perspective view illustrating an outline structure of a printer.

The printer 1 of this embodiment, as shown in FIG. 1, is equipped with an ink jet recording head (hereinafter, referred to as recording head) 2 mounted on a carriage 3 as a liquid discharging head. The printer 1 includes a carriage moving mechanism 5 which moves the carriage 3 in a main scanning direction which is a widthwise direction of recording paper 4 (a kind of a discharge target in the invention) in a reciprocating manner, a paper sending mechanism 6 which transports the recording paper 4 in a sub-scanning direction which is perpendicular to the main scanning direction, a platen 7 on which the recording paper 4 is placed, a capping mechanism 8 provided at a position (home position) separated from one end of the platen 7 in the main scanning direction, and a controller 9 which controls the whole printer 1.

In the carriage 3, an ink cartridge 11 for containing ink of each color, for example, yellow (Y), magenta (M), cyan (C), and black (K) (corresponding to the liquid in the invention), separately is detachably mounted. The ink in the ink cartridge 11 is supplied to the recording head 2. In the main body of the printer 1, a linear encoder 12 for detecting the position of the carriage 3 is placed. The home position of the carriage 3 can be managed on the basis of a detection signal from the linear encoder 12.

Figure 2:
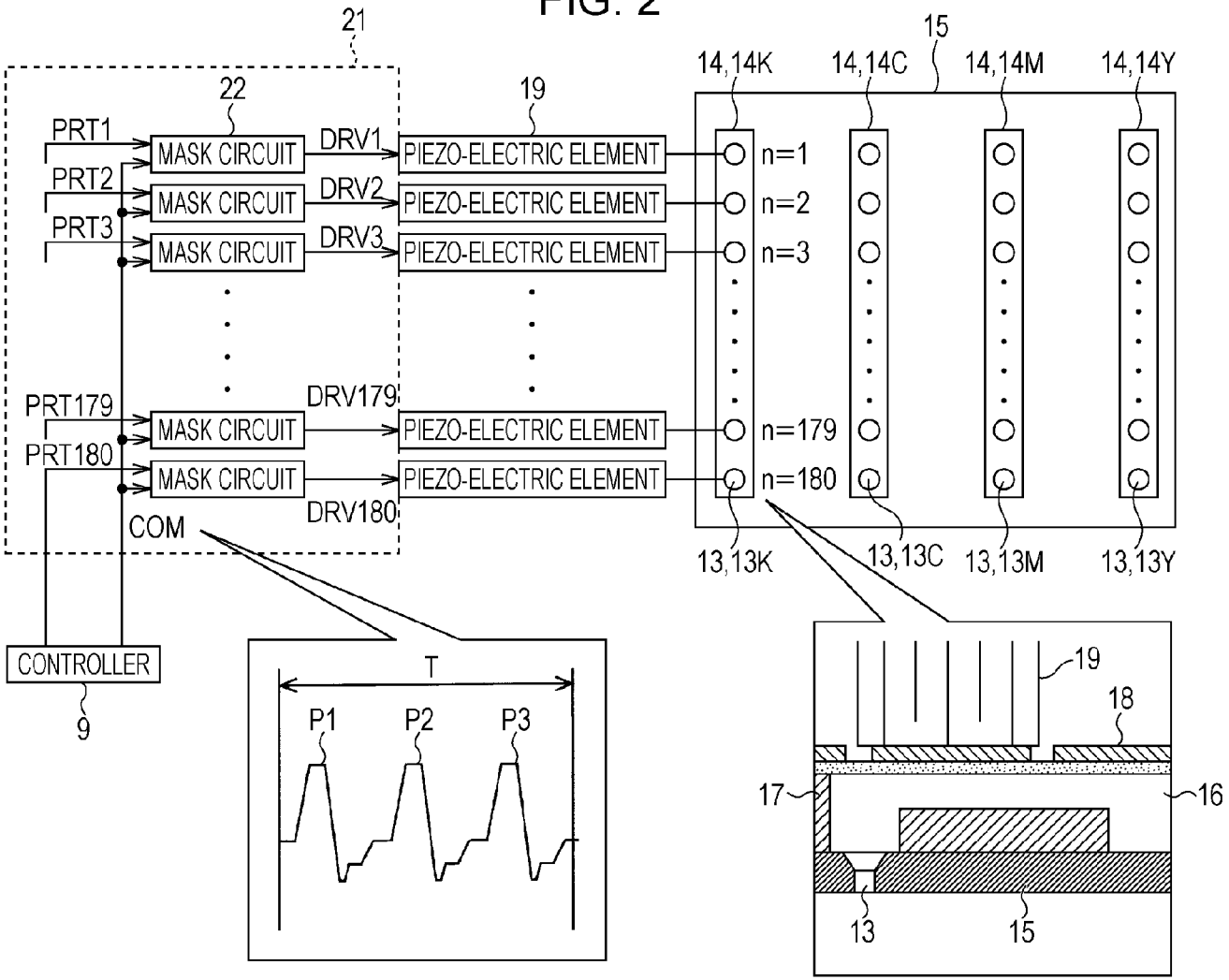
FIG. 2 is a schematic view for explaining a configuration of a recording head.

As shown in FIG. 2, the recording head 2 includes a nozzle plate 15 with nozzle orifices 13 formed therein, a channel-formed plate 17 in which ink channels including pressure generating chambers 16 communicating with the nozzle orifices 13 are formed, a flexible vibrating plate 18 for sealing open portions of the pressure generating chambers 16, and piezoelectric elements 19 (corresponding to discharge drivers in the invention) bonded to the upper surface of the vibrating plate 18. The nozzle plate 15 has a plurality of nozzle orifices 13 (for example, 180 nozzle orifices in the present embodiment) arranged in a sub-scanning direction for discharging ink of cyan (C), ink of magenta (M), ink of yellow (Y), and ink of black (K), the nozzle orifices being arranged in a plurality of nozzle columns 14. Four nozzle columns 14 are provided so as to correspond to respective colors, and the four nozzle columns are 14C, 14M, 14Y, and 14K.

The recording head 2 includes a plurality of mask circuits 22 provided on a head driving plate 21, corresponding to the plurality of piezoelectric elements 19 which drive the nozzle orifices 13, respectively. A voltage (drive signal) from the mask circuit 22 is applied to the piezoelectric element 19 to drive the piezoelectric element 19 in an expanding or contracting manner. Thus, the volume of the pressure generating chamber 16 is increased or decreased, so that the pressure change of ink in the pressure generating chamber 16 is brought about. Therefore, the ink is discharged from the nozzle orifices 13 by controlling the pressure change. The mask circuit 22 is applied with a drive signal COM or a print signal PRTn generated by a drive signal generator circuit 25 (a kind of a drive signal generator in the invention, see FIG. 1) of the controller 9. The letter "n" at the end of the reference PRTn following the word "print signal" is a number for specifying the specific nozzle orifice 13 included in the nozzle column 14. In the present embodiment, as the nozzle column 14 is composed of 180 nozzle orifices 13, n is an integer selected in the range from 1 to 180.

As shown in FIG. 1, the controller 9 is composed of a microprocessor in which a central processing unit (CPU) 26 (functioning as an electrical change detector or a discharge checking portion along with a discharge checking device 32 which will be described below) is the principal part, a read only memory (ROM) 27 which stores various kinds of programs, a random access memory (RAM) 28 which temporarily stores or saves data, a flash memory 29 which allows data to be written thereto and erased therefrom, an interface (I/F) 30 which performs exchanges of information with external equipment, and a correlation information storing portion 31 which stores information relating to temperatures of ink which will be described below.

The ROM 27 stores various kinds of programs including a main routine, a discharge checking routine which will be described below, and a printing processing routine. The RAM 28 is provided with a printing buffer region. Printing data sent to the printing buffer via the I/F 30 from the external equipment is stored in the printing buffer region of the RAM 28. A position signal or the like from the linear encoder 12 is not only input into the controller 9 via an input port but also a printing job or the like output from the external equipment is input into the controller 9 via the I/F 30. Further, a control signal to be input into the recording head 2 (including the mask circuit 22 and the piezoelectric element 19), a control signal to be input into the carriage moving mechanism 5, a drive signal to be input into the paper sending mechanism 6, and an operation control signal to be input into the capping mechanism 8 are output from the controller 9 via an output port (not shown). Still further, printing status information of the external equipment or the like is output via the I/F 30.

As shown in FIG. 2, the drive signal generator circuit 25 outputs a drive signal COM with repetition units in which each repetition unit mainly includes three pulses, i.e., a first discharge pulse P1, a second discharge pulse P2, and a third discharge pulse P3 to the mask circuit 22 for a period T for a single pixel (a single discharge period or a single recording period). The discharge pulses P1 to P3 will be called normal drive pulses P (corresponding to discharge drive pulses in this invention). The normal drive pulses P are drive pulses used in a normal recording mode (printing mode) for printing images or text letters on the recording paper 4 by discharging ink from the nozzle orifices 13. The drive signal generator circuit 25 generates a checking drive signal COM' used in a discharge checking routine (which will be described below and which corresponds to electrical change information acquiring processing and discharge checking processing) or a checking routine for checking whether the ink is being normally discharged from the nozzle orifices 13. The checking drive signal COM' is a drive signal including a discharge checking drive pulse Pt which can increase the flight velocity of the ink in comparison with the normal drive pulse P. When the drive signal COM (COM') and the printing signal PRTn are input, the mask circuit 22 generates essential drive pulses DRVn (n is an integer in the range from 1 to 180) from the drive signal COM (COM') on the bases of these signals and selectively outputs the generated drive pulses DRVn to the piezoelectric elements 19.

Figure 3A:
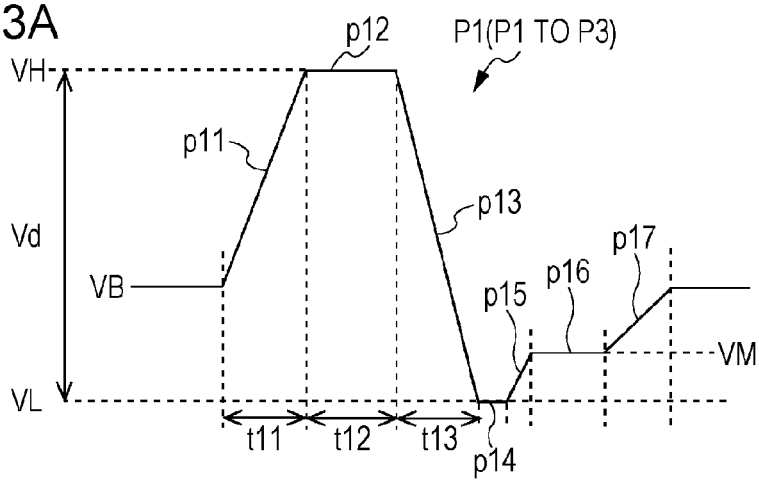
FIG. 3A is a view illustrating a waveform of a normal drive pulse.
Figure 3B:
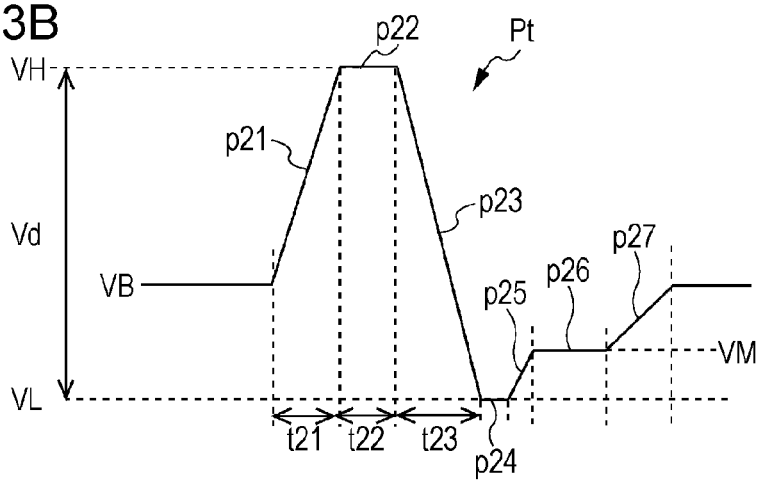
FIG. 3B is a view illustrating a waveform of a discharge checking drive pulse.

FIG. 3A is a waveform for explaining the configuration of the normal drive pulse P in the drive signal COM generated by the drive signal generator circuit 25 and FIG. 3B is a waveform for explaining the configuration of the discharge checking drive pulse Pt in the checking drive signal COM'.

As shown in FIG. 3A, the normal drive pulse P is composed of a first preliminary expansion component p11 in which a potential rises from a reference potential VB to the highest potential VH at a fixed gradient, a first expansion holding component p12 in which the highest potential VH which is a potential at the back end of the first preliminary expansion component p11 is maintained for a predetermined time, a first discharge component p13 in which the potential falls from the highest potential VH to the lowest potential VL at a relatively abrupt gradient, a first contraction holding component p14 in which the lowest potential VL is maintained for a predetermined time, a first intermediate expansion component p15 in which the potential rises from the lowest potential VL to an intermediate potential VM which is an intermediate potential between the lowest potential VL and the reference potential VB at a fixed gradient, a first intermediate holding component p16 in which the intermediate potential VM is maintained for a predetermined time, and a first recovery expansion component p17 in which the potential is recovered from the intermediate potential VM to the reference potential VB at a fixed gradient.

As shown in FIG. 3B, the discharge checking drive pulse Pt of the checking drive signal COM' is composed of the same kinds of waveform components as the normal drive pulse P. That is, it is composed of a second preliminary expansion component p21 in which the potential rises from the reference potential VB to the highest potential VH at a fixed gradient, a second expansion holding component p22 in which the highest potential VH which is the potential at the back end of the second preliminary expansion component p21 is maintained for a predetermined time, a second discharge component p23 in which the potential falls from the highest potential VH to the lowest potential VL at a relatively abrupt gradient, a second contraction holding component p24 in which the lowest potential VL is maintained for a predetermined time, a second intermediate expansion component p25 in which the potential rises from the lowest potential VL to the intermediate potential VM at a fixed gradient, a second intermediate holding component p26 in which the intermediate potential VM is maintained for a predetermined time, and a second recovery expansion component p27 in which the potential is recovered from the intermediate potential VM to the reference potential VB at a fixed gradient.

When the drive pulse P or Pt is supplied to the piezoelectric element 19, the piezoelectric element 19 operates in the following manner. First, when the preliminary expansion component p11 or p21 is supplied to the piezoelectric element 19, the piezoelectric element 19 contracts and thus the pressure generating chamber 16 expands to the maximum volume corresponding to the highest potential VH from the reference volume corresponding to the reference potential VB along with the contraction of the piezoelectric element 19. As a result, a meniscus which is in a state of being viewed through the nozzle orifice 13 goes inside the pressure generating chamber 16. The expanded state of the pressure generating chamber 16 is constantly maintained while the expansion hold component p12 or p22 is supplied.

After the expansion holding component p12 or p22 the discharge component p13 or p23 is subsequently supplied to the piezoelectric element 19, the corresponding piezoelectric element 19 extends and the volume of the pressure generating chamber 16 abruptly decreases from the maximum volume to the minimum volume corresponding to the lowest potential VL. Owing to the abrupt contraction of the pressure generating chamber 16 the ink in the pressure generating chamber 16 is pressed and several pl to several tens pl of ink is discharged from the nozzle orifice 13. The contracted state of the pressure generating chamber 16 is maintained for a short time during the supply period of the contraction holding component p14 or p24. After that, the intermediate expansion component p15 or p25, the intermediate holding component p16 or p26, and the recovery expansion component p17 or p27 are sequentially supplied to the piezoelectric element 19, and the pressure generating chamber 16 is recovered to the reference volume corresponding to the reference potential VB from the volume corresponding to the lowest potential VL.

In this manner, the basic function for discharging ink is common to the normal drive pulse P and the discharge checking drive pulse Pt. However, both of them are set such that the flight velocities of the ink discharged from the nozzle orifice 13 are different from each other when they are applied to the piezoelectric element 19. In more detail, the flight velocity Vmt of the ink when the discharge checking drive pulse Pt is used in the discharge checking routine is set to be higher than the flight velocity Vm of the ink when the normal drive pulse P is used in the normal recording mode.

Figure 4:
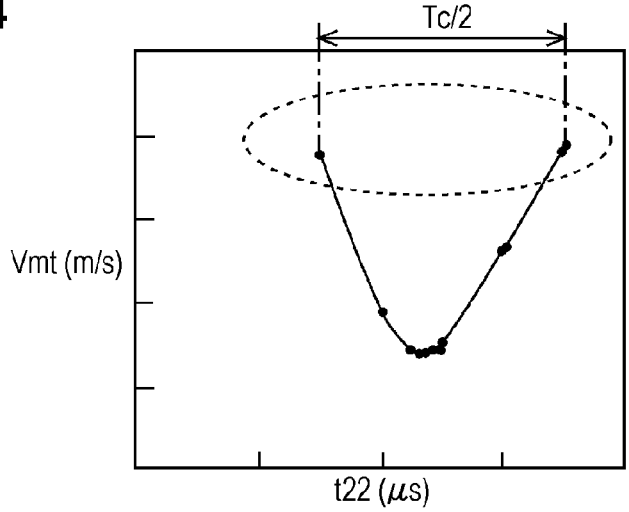
FIG. 4 is a graph showing the change in the flight velocity of ink when changing a period of time of an expansion holding component of a drive pulse.

FIG. 4 is a graph showing the change in the flight velocity Vmt of the ink when the time period t22 of the second expansion holding component p22 is changed. As shown in the graph, if the time period t22 is changed, it is found that the flight velocity Vmt of the ink increases. The flight velocity of the discharged ink changes according to the state of the meniscus at the discharge timing, for example the position or moving speed of the meniscus. The frequency of pressure vibrations generated by the second preliminary expansion component p21 which causes pressure vibrations of the ink in the pressure generating chamber 16 is called the inherent vibration frequency Tc of the pressure generating chamber 16, which is determined for each of the liquid discharging heads. The state of the meniscus depends on the pressure vibrations which excite the ink in the pressure generating chamber 16. That is, the meniscus vibrates according to the inherent vibration frequency Tc and the flight velocity of the ink changes. Accordingly, it is possible to improve the flight velocity Vmt of the ink by setting the time period of each of the components of the waveform by taking the inherent vibration frequency Tc into account.

The discharge checking drive pulse Pt set in the above manner improves the flight velocity Vmt of the ink by a percentage value of up to several tens with respect to the flight velocity Vm of the ink of the normal drive pulse P. However, there is no big change in the discharge amount of the ink. That is, it is possible to improve only the flight velocity while suppressing the change in the discharge amount of ink. Further, owing to the discharge checking drive pulse Pt set to improve the flight velocity of the ink in comparison with the case of using the normal drive pulse P, the flight direction of the discharged ink draws a big curve in comparison with the flight direction of the ink at the normal printing, and there are ink droplets (satellite ink droplets) which are likely to fly following the main ink droplet. Accordingly, this is not suitable for the printing of the image in the normal recording mode. On the other hand, this is not a problem in the discharge checking routine which will be described below because a small curve in the flight direction of the ink and a small amount of satellite ink droplets do not affect the checking accuracy.

Figure 5:
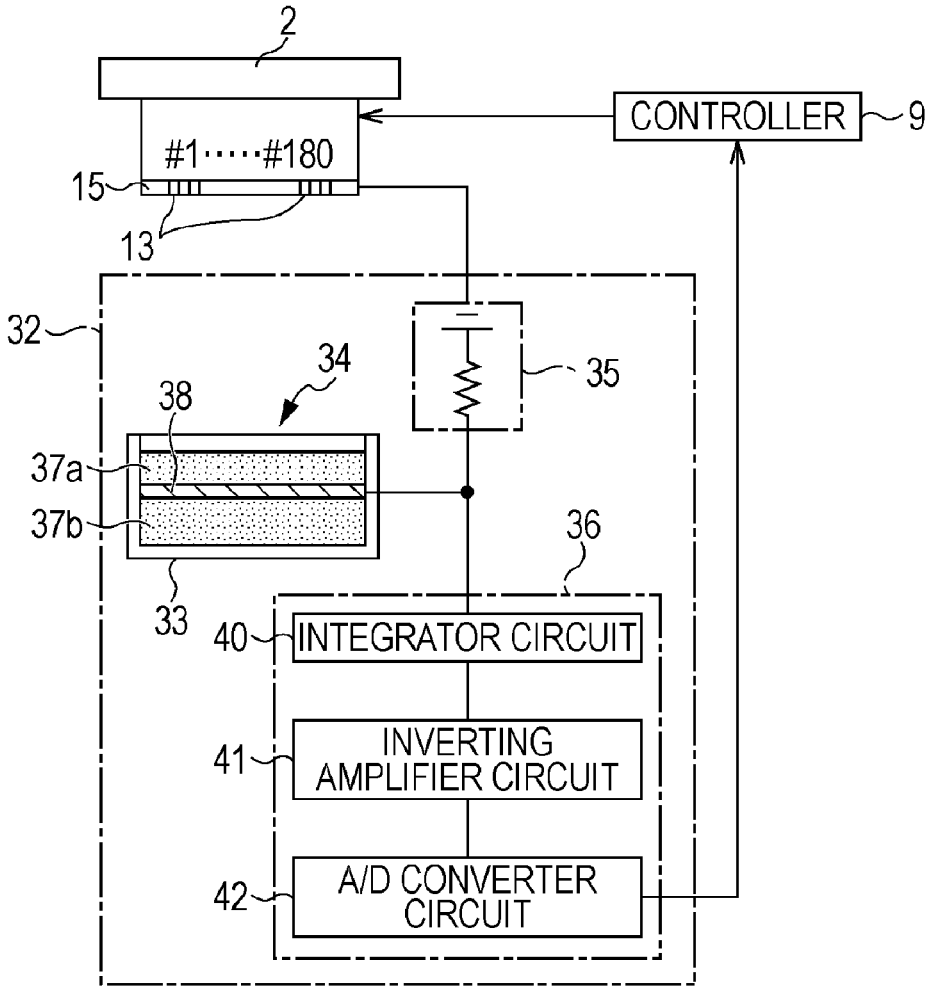
FIG. 5 is a schematic view for explaining a structure of a discharge checking device.

Accordingly, the printer 1 is provided with the discharge checking device 32 (functioning as the electric characteristic change detecting portion and the discharge checking portion along with the CPU 26 in this invention) which performs the discharge checking routine. FIG. 5 is a schematic view showing the discharge checking device 32. The discharge checking device 32 includes a cap member 33 serving as a liquid receiving portion provided in a capping mechanism 8 placed at the home position, a checking region 34 provided in the cap member 33, a voltage applying circuit 35 for applying a voltage between the checking region 34 and a nozzle plate 15 (corresponding to a conductive portion in the invention) of the recording head 2, and a voltage detector circuit 36 which detects a voltage of the checking region 34. The cap member 33 is a tray-shaped member which is open at the top surface and is made of an elastic member such as an elastomer. The inside of the cap member 33 is provided with an ink absorbing member 37. The ink absorbing member 37 is composed of an upper absorbing member 37*a* and a lower absorbing member 37*b*. A mesh-shaped electrode member 38 is provided between the absorbing members 37*a* and 37*b*. The upper absorbing member 37*a* is made of sponge having a conductive characteristic so that it has the same potential as the electrode member 38. The sponge is urethane sponge having high permeability so that the ink placed on the sponge can rapidly move down. Ester-based urethane sponge is used in the present embodiment. The surface of the upper absorbing member 37*a* corresponds to the checking region 34. The lower absorbing member 37*b* has a high ink-bearing characteristic in comparison with the upper absorbing member 37*a* and is made of a piece of unwoven cloth such as felt. The electrode member 38 is a lattice-shaped mesh made of metal such as stainless steel. Accordingly, the ink absorbed in the upper absorbing member 37*a* at the first stage is absorbed in the lower absorbing member 37*b* through pores of the lattice-shaped electrode member 38 and then maintained in the lower absorbing member 37*b*. Either or both of the upper absorbing member 37*a* and the lower absorbing member 37*b* may be omitted.

The voltage applying circuit 35 has the electrode member 38 and the nozzle plate 15 of the recording head 2 electrically connected to each other such that the electrode member 38 has a positive polarity and the nozzle plate 15 has a negative polarity via a direct current power source (for example, several hundred volts [V]) and a resistor element (for example, several mega ohms [MΩ]) of a main body of the printer. Here since the electrode member 38 is in contact with the upper absorbing member 37*a* which is conductive, the surface of the upper absorbing member 37*a*, i.e. the checking region 34, has the same potential as the electrode member 38. The voltage detecting circuit 36 includes an integrator circuit 40 which outputs a signal by integrating voltage signals of the electrode member 38, an inverting amplifier circuit 41 outputs a signal by inverting and amplifying the signal output from the integrator circuit 40, and an A/D converter circuit 42 which outputs a signal to the controller 9 by A/D-converting the output signal from the inverting amplifier circuit 41. The integrator circuit 40 is to amplify the change of the voltage to output the increased amount of change by integrating the voltage changes (a kind of electrical change) attributable to the flight and placement of a plurality of ink droplets. The inverting amplifier circuit 41 is to invert polarities of the voltage changes (positive or negative) of the signal output from the integrator circuit 40 and to amplify the signal output from the integrator circuit 40 in a predetermined amplifying ratio to output the inverted and amplified signal. The A/D converter circuit 42 converts the analog signal output from the inverting amplifier circuit 41 to a digital signal and outputs the converted digital signal as a detection signal to the controller 9.

Figure 6A:
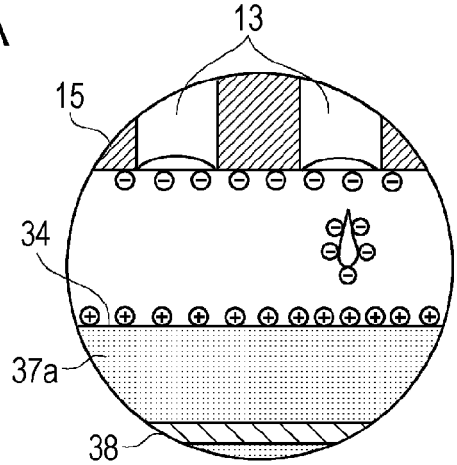
FIGS. 6A and 6B are schematic views for explaining the principle for checking the discharge of ink.
Figure 6B:
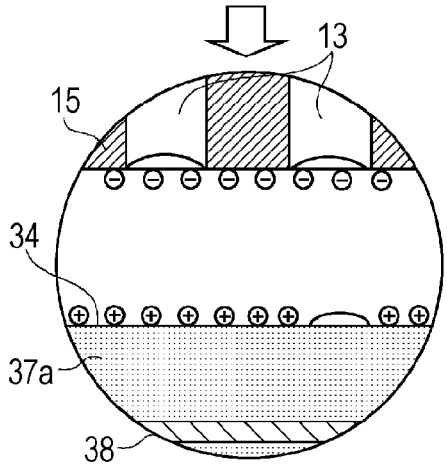

In the discharge checking routine using the discharge checking device 32 having the above structure, the recording head 2 is positioned above the cap member 33 and the cap member 33 is raised to a position where the ink discharged from the recording head 2 can hit the checking region 34 by en elevating mechanism of the capping mechanism 8 so that the checking region 34 comes to face the nozzle-formed surface (nozzle plate 15) of the recording head 2 in a non-contact state. In the state in which a voltage is applied between the nozzle plate 15 and the electrode member 38 by the voltage applying circuit 35, the discharge checking drive pulse Pt is used to drive the piezoelectric element 19 and the ink is discharged from the nozzle orifice 13. In the case of the present embodiment, as shown in FIG. 6A, since the nozzle plate 15 has negative polarity, some of negative charges of the nozzle plate 15 move to the ink and the discharged ink becomes negatively charged. As the ink droplet comes closer to the checking region 34 of the cap member 33, the positive charges increase at the checking region 34 (the surface of the upper absorbing member 37*a*) due to the electrostatic induction. This leads to the state in which the voltage between the nozzle plate 15 and the electrode member 38 becomes higher than an initial voltage value at the time that the ink was not discharged because current induced by the electrostatic induction is flowing. After that, as shown in FIG. 6B, if the ink droplet hits the upper absorbing member 37*a*, the positive charges of the upper absorbing member 37*a* are neutralized by the negative charges of the ink. As a result, the voltage between the nozzle plate 15 and the electrode member 38 becomes lower than the initial voltage. After that, the voltage between the nozzle plate 15 and the electrode member 38 is restored to the initial voltage value.

Figure 7:
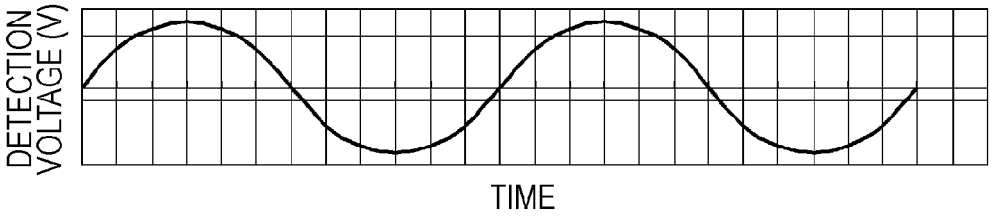
FIG. 7 is a view illustrating an exemplary waveform of a detecting signal output from a voltage detector circuit of the discharge checking device.

FIG. 7 shows an exemplary waveform of a detection signal output from the voltage detector circuit 36 of the discharge checking device 32. Since the amplitude of the detection signal for an ink droplet of a single shot is very small, the ink is discharged from a single nozzle orifice 13 at the time of detection a plurality of times. For such a reason, since the detection signal is the integrated value of the detection voltages with respect to the amount of ink of a plurality of shots by the integrator circuit 40 and is inverted and amplified by the inverting amplifier circuit 41, the detection signal becomes an output waveform whose amplitude is sufficiently large for detection. The signal output from the voltage detector circuit 36 becomes opposite to the input signal in the direction of the amplitude of the waveform since it passes through the inverting amplifier circuit 41.

In this manner, the discharge checking is sequentially performed column by column with respect to the nozzle orifices 13 which are components of the nozzle column 14, and the detection signal which is the detection result output from the discharge checking device 32 becomes accumulated in the RAM 28 of the controller 9. The CPU 26 of the controller 9 functions as the electrical change detecting portion and the discharge checking portion in the invention, and acquires the amplitude of the received detection signal as the electrical change information. In more detail, it detects the maximum value and the minimum value of the detection signal and acquires the potential difference thereof as the amplitude of the detection signal. The CPU 26 judges whether the ink is being normally discharged from each of the nozzle orifices 13 on the basis of the amplitude of the detection signal (detection voltage). Here in the case in which the ink is not discharged from the nozzle orifice 13 at all or discharged by only in a much smaller amount than a normal discharge amount (the ink amount desired to be discharged at the time of design) or by almost zero, the amplitude of the detection signal is small in comparison with the detection signal whose amplitude is normal, i.e. in comparison with the time in which the normal amount of ink is discharged from the nozzle orifice 13, and thus it is possible to judge whether the ink is being normally discharged from the nozzle orifice 13 on the basis of whether the amplitude of the detection signal is smaller than the preset threshold value. Further, the printer 1 judges whether the ink is being normally discharged from the nozzle orifice 13 or not by using the discharge checking device 32 at a predetermined time.

Figure 8:
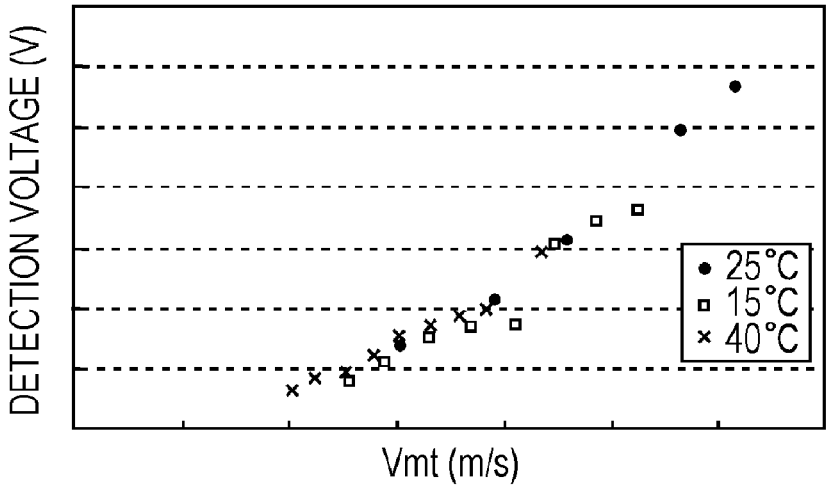
FIG. 8 is a graph showing a relationship between the flight velocity of ink and a detecting voltage.

FIG. 8 is a graph showing the relationship between the flight velocity Vmt of ink (the flight velocity of ink when the ink is discharged using the discharge checking drive pulse Pt) and the amplitude (detection voltage (V)) of the detection signal. As shown in FIG. 8, the detection voltage (V) depends on the flight velocity of the ink and has a tendency such that the detection voltage (V) becomes higher as the flight velocity gets higher. Here, when the charged ink moves through an electric field between the electrodes having a predetermined distance x therebetween (i.e. between the nozzle plate 15 and the checking region 34 in the case of the present embodiment) at the speed of Vmt and the ink hits the checking region 34, if the charges change to dQ at the time dt, the current I flowing at the time dt is expressed in equation (1). Here the direction (positive and negative) of the current is not considered.

$$I = Vmt \times dQ/dx \quad (1)$$

Accordingly, as the flight velocity Vmt of ink becomes higher, the created current I becomes larger as in equation (1). Therefore the detection voltage (V) also becomes higher along with the increase of the current.

Figure 9:
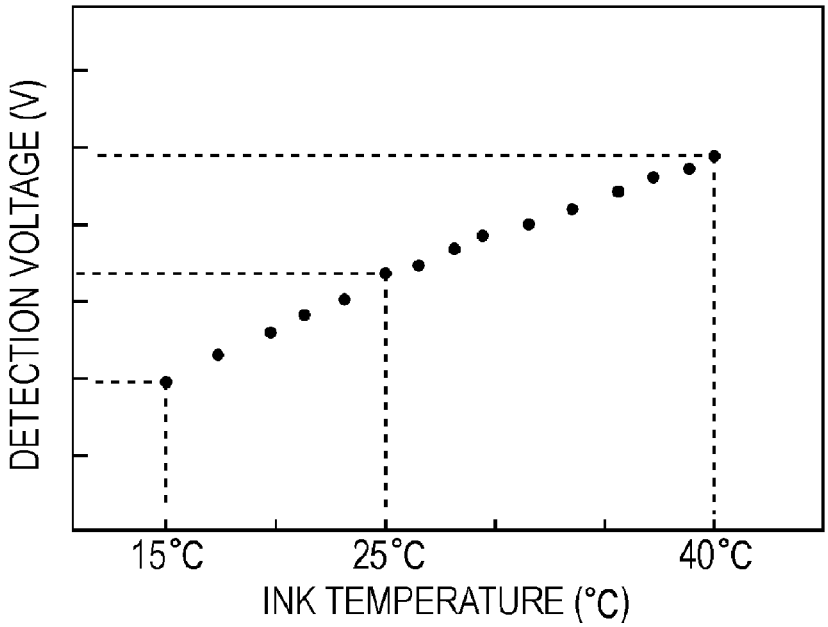
FIG. 9 is a graph showing correlation between a temperature of ink and a detecting voltage.

The correlation information storing portion 31 of the controller 9 stores correlation information showing the relationship between the amplitudes (detection voltages) of the detection signals obtained in the same procedure as the discharge checking and the temperatures of the liquid therein. In more detail, as shown in FIG. 9, a plurality of the amplitudes (detection voltages) of the detection signals is obtained under conditions in which the temperatures of the ink (temperature settings of the ink discharged from the nozzle orifices 13) are differently set in the same procedure as the above discharge checking routine, i.e. in the procedure for discharging the ink to the checking region 34 from the nozzle orifice 13 by driving the piezoelectric element 19 by using the discharge checking drive pulse Pt, and the relationship between the set temperatures of the ink and the amplitudes of the detection signals is stored in the correlation information storing portion 31 as the correlation information (for example, table data or a correlation equation (approximation equation)). When acquiring the correlation information, the discharge checking drive pulse Pt always has the identical waveform regardless of the temperature setting.

The correlation between the ink temperature and the amplitude (detection voltage) of the detection signal shown in FIG. 9 is the correlation acquired in this embodiment. In the range of temperature shown in FIG. 9, i.e. in the range of ambient temperature in which it is considered that the printer 1 is practically used, as the temperature rises, the detection voltage rises too. That is, the correlation which is a predetermined relationship between the temperature and the detected electrical change is acquired. From the above description, this is assumed such that with the change of the temperature, the viscosity of the ink changes, the inherent vibration frequency Tc of the pressure generating chamber 16 changes, the flight velocity Vmt of the ink changes along with the change of the inherent vibration frequency, and the detection voltage changes along with the change of the ink flight velocity Vmt.

Moreover, besides the correlation information, ink temperatures and correction information showing correlation between the ink temperatures and corrected values corresponding to the ink temperatures are preliminarily stored in the correlation information storing portion 31. The correction information is information which is needed to make the ink discharged from the nozzle orifices 13 hit the recording paper 4 while satisfying preset conditions (hitting position, and dot diameter formed by hitting) although the temperature and viscosity of the ink change. In more detail, for example, for every ink temperature, the corrected values relating to the waveform of the normal drive pulse P (time adjusted data of starting timing of the normal drive pulse P, continuing time adjusted data of each of the components which constitute the normal drive pulse P, and drive voltage correction data of the normal drive pulse P) are stored or a correlation equation between the ink temperatures and the corrected values is stored.

Next, the operation of the printer 1 having the above structure and particularly a correcting procedure for correcting the discharge checking drive pulse Pt used when discharging ink toward the cap member 33 and the normal drive pulse P used when discharging ink toward the recording paper 4 (the discharge target which is other than the cap member 33) will be described.

In the printer 1, in the case in which the ambient temperature (a temperature inside the printer 1, and particularly a temperature around the nozzle orifice 13) changes due to heat generation of the recording head 2, the temperature of the ink changes along with the change of the ambient temperature, and thus the viscosity of ink (ink viscosity) around the nozzle orifice 13 changes. In more detail, for example, in the case in which the temperature is beyond room temperature (for example, 25° C., hereinafter appropriately called reference temperature), the ink viscosity is lowered. For this reason, the flight velocity when discharging the ink using the normal drive pulse P which is not processed to adapt to the temperature variation or the discharge checking drive pulse Pt is accelerated. As the flight velocity of the ink becomes higher than the flight velocity at the normal temperature, if the curve in the flight direction becomes bigger or the satellite ink droplets are separated from main ink droplets and turn to mist, the images and text letters printed on the recording paper 4 are likely to be blurred in the normal printing. In the discharge checking routine, the ink serving as a barometer for the discharge checking is attached to a region other than the checking region 34 which is for capturing the ink and thus the checking accuracy is likely to be lowered. On the other hand, in the case in which the temperature becomes lower than the room temperature, the ink viscosity increases. Accordingly, the flight velocity of the ink is lowered. If the flight velocity of the ink is lowered, it is difficult for the ink to reach the recording paper 4 in the normal printing, and thus the printed images and text letters are cracked and are likely to be blurred. Further, the detection voltage is lowered in the discharge checking routine and there is a chance that the detection accuracy is lowered for this reason. Accordingly, the drive signal generator circuit 25 serves as a drive signal correcting unit, estimates an ink temperature on the basis of the correlation information stored in the correlation information storing portion 31, and corrects the discharge checking drive pulse Pt and the normal drive pulse P on the basis of the estimated ink temperature (corresponding to an estimated liquid temperature in the invention).

The correction processing of the discharge checking drive pulse Pt will be described in more detail. First, ink temperature estimating processing (electrical change information acquiring processing) for estimating a current ink temperature using the discharge checking drive pulse Pt as the information acquiring drive pulse is performed. In more detail, the drive signal generator circuit 25 serving as the drive signal correcting unit makes the ink be discharged to the cap member 33 from the nozzle orifices 13 by generating the discharge checking drive pulse Pt. With this operation, the amplitude of the detection signal is acquired as the temperature estimating amplitude (temperature estimating detection voltage) by the discharge checking device 32 and the CPU 26. Then, the acquired temperature estimating detection voltage and the correlation information in the correlation information storing portion 31 are checked and the ink temperature corresponding to the temperature estimating detection voltage is estimated. Thus, it is set as the estimated ink temperature. The discharge checking drive pulse Pt serving as the information acquiring drive pulse has the same waveform as the discharge checking drive pulse Pt used when acquiring the correlation information.

After the estimated ink temperature is obtained, the discharge checking drive pulse Pt is corrected according to the estimated ink temperature. Further, the ink flight velocity Vmt' when the ink is discharged using the corrected discharge checking drive pulse Pt is harmonized with the flight velocity Vmt of the ink when the ink is discharged at the reference temperature using the uncorrected discharge checking drive pulse Pt. That is, the discharge checking drive pulse Pt is corrected such that the flight velocities of the ink become equal to each other regardless of the ink temperatures (or ambient temperatures). For example, in the case in which the ink temperature becomes higher than the reference temperature, the flight velocity of the ink becomes higher than the flight velocity at the room temperature. Accordingly, the time period t21 of the second preliminary expansion component p21 and the time period t22 of the second expansion holding component p22 are increased to be longer than those before the correction, respectively, and the flight velocity of the ink is lowered and becomes equal to the flight velocity at the room temperature. On the other hand, in the case in which the ink temperature becomes lower than the reference temperature, the flight velocity of the ink becomes lower than that at the room temperature. For this reason, the flight velocity of the ink is increased by making the time period t21 of the second preliminary expansion component p21 and the time period t22 of the second expansion holding component p22 shorter than the corresponding time periods before correction, respectively. Therefore, the flight velocity of the ink becomes equal to the flight velocity at the room temperature.

Further, as the ink temperature varies along with the variation of the ambient temperature and thus the ink viscosity varies, the amount of ink (weight or volume) discharged from the nozzle orifice 13 increases or decreases. If the amount of ink slightly increases or decreases, it does not have a large influence on the checking accuracy in the discharge checking. However, if the variation is excessively large, there is a possibility that it will influence the checking accuracy. Accordingly, it is desirable that the amount of ink discharged by a single shot should be corrected so as to be equal to the amount (corrected value) of ink discharged at the reference temperature. In more detail, the drive voltage Vd (a potential difference between the lowest potential VL and the highest potential VH) of the discharge checking drive pulse Pt is corrected. For example, in the case in which the estimated ink temperature is higher than the reference temperature, the waveform of the discharge checking drive pulse Pt is corrected and the drive voltage Vd is lowered to below the reference value (voltage set at the room temperature). With such an operation, the amount of ink discharged from the nozzle orifice 13 is decreased and adjusted to be equal to an optimum value. In a similar manner, in the case in which the estimated ink temperature is lower than the reference temperature, the waveform of the discharge checking drive pulse Pt is corrected such that the drive voltage Vd is higher than the reference value. Therefore, the amount of ink discharged from the nozzle orifice 13 is increased to be equal to the optimum value.

If the setting of the flight velocity and the amount of discharged ink is adjusted by correcting the discharge checking drive pulse Pt, the discharge checking routine is executed using the corrected discharge checking drive pulse Pt, and whether the ink is being normally discharged from the nozzle orifice 13 or not is judged.

In this manner, in the printer 1 of the invention, since the discharge checking drive pulse Pt (i.e. the waveform of the discharge checking drive pulse Pt in detail) is corrected according to the estimated ink temperature, it is possible to prevent trouble such as the judging accuracy of the discharge checking being lowered due to the variation of the ink temperature attributable to the variation of the ambient temperature. Further, it is possible to use the estimated ink temperature estimated on the basis of the information relating to the temperature of the ink instead of the temperature of a component around the ink (for example, the nozzle orifice 13) as the judging criteria for correction of the discharge checking drive pulse Pt. Accordingly, it is possible to perform the correction suitable for the discharge checking drive pulse Pt with respect to each of ink temperatures and sufficiently suppress the influence (for example, variance of flight velocities of ink droplets, and variance of the discharge amount) on the discharge state of the ink by the variation of the ink temperature.

On the other hand, the correction processing of the normal drive pulse P is performed such that the hitting state (hitting position, and the dot diameter which is formed by the hitting) of the ink discharged using the corrected normal drive pulse P satisfies the preset hitting condition. In more detail, the ink temperature estimating processing (electrical change information acquiring processing) for estimating the current ink temperature by using the discharge checking drive pulse Pt as the information acquiring drive pulse is performed. In more detail, the drive signal generator circuit 25 serving as the drive signal correcting unit generates the discharge checking drive pulse Pt to discharge the ink from the nozzle orifice 13 to the cap member 33 and acquires the amplitude of the detection signal as the temperature estimating amplitude (temperature estimating detection voltage) on the basis of the discharge operation by the discharge checking device 32 and the CPU 26. Further, the temperature estimating detection voltage and the correlation information in the correlation information storing portion 31 are checked, and the ink temperature corresponding to the temperature estimating detection voltage is estimated as the estimated ink temperature. The discharge checking drive pulse Pt serving as the information acquiring drive pulse has the same waveform as the discharge checking drive pulse Pt used when acquiring the correlation information.

When the estimated ink temperature is obtained, the correction information in the correlation information storing portion 31 is checked, and the correction value corresponding to the estimated ink temperature is acquired. Therefore the waveform of the normal drive pulse P (starting timing of the normal drive pulse P, continuing time of each of the components, and drive voltage) is corrected (adjusted) on the basis of the acquired correction value, and then the ink is discharged from the nozzle orifice 13 using the adjusted normal drive pulse P. As a result, it is possible to suppress degradation of the discharge accuracy of the ink attributable to the variation of the ink temperature. Further, it is possible to make the estimated ink temperature obtained on the basis of information relating to the temperature of the ink rather than the temperature of the part (for example, nozzle orifice 13) around the ink the judging criteria for the correction of the normal drive pulse P. Accordingly, it is possible to perform the correction suitable for the normal drive pulse P according to the ink temperature, and sufficiently suppress the variation of the ink temperature from affecting the discharge state of the ink (for example, variation of the flight velocity of the ink, variation of the discharge amount of the ink). The hitting state (for example, misalignment of the hitting position of the ink on the recording paper 4, diameter of the dot formed by hitting) of the ink discharged to the recording paper 4 can be optimally corrected regardless of the variation of the ink temperature. Further, it is not necessary for the recording head 2 to be equipped with a temperature sensor for measuring the ink temperature, and it is possible to reduce the weight of the recording head 2, simplify the structure of the recording head 2, and improve the moving speed of the recording head 2.

In the case in which the recording head 2 performs two-way discharging in which it is possible to discharge ink in both the forward movement and the backward movement in the main scan direction, either the drive timing of the normal drive pulse P (forward movement drive pulse) supplied to the piezoelectric element 19 in the forward movement or the drive timing of the normal drive pulse P (backward movement drive pulse) supplied to the piezoelectric element 19 in the backward movement is corrected according to the estimated ink temperature, the ink discharge timing and the flight velocity are adjusted in either the forward movement or the backward movement. In more detail, the correction value applied to the forward movement drive pulse (forward movement correction value) and the correction value applied to the backward movement drive pulse (backward movement correction value) are in one set to be a two-way correction value, the two-way correction value is preliminarily stored in the correlation information storing portion 31 as the correction information, and the forward movement drive pulse and the backward movement drive pulse are corrected on the basis of the two-way correction value corresponding to the estimated ink temperature obtained through the ink temperature estimating processing. At this time, if only the correction content of the forward movement correction value is "no correction", only the backward movement drive pulse is corrected. Conversely if only the correction content of the backward movement correction value is "no correction", only the forward movement drive pulse is corrected. As the result of such correction processing, although the ink temperature varies, it is possible to harmonize the correlation between the hitting position (forward hitting position) of the ink discharged using the forward movement drive pulse and the hitting position (backward hitting position) of the ink discharged using the backward movement drive pulse with the predetermined setting (for example, the state in which they are spaced from each other by a predetermined distance, or the state in which they partially or completely overlap).

The present invention is not limited to the above-described embodiments but may be altered, modified, and changed on the basis of the description of the claims.

For example, although the cap member 33 of the capping mechanism 8 is used as the liquid receiving portion of the invention in the above embodiment, a liquid receiving portion in a discrete form provided only for the discharge checking may be used without limitation by the embodiment.

Although the electrode member 38 and the nozzle plate 15 of the recording head 2 are electrically connected to each other such that the electrode member 38 serves as a positive electrode and the nozzle plate 15 of the recording head 2 serves as a negative electrode in the above embodiment, such connection is not limited thereto. The polarities of both may be switched to be opposite to the above example. Either the positive electrode or the negative electrode may become the ground potential (earth potential) GND whose potential is almost zero. The conductive portion of the recording head 2 is not limited to the nozzle plate 15 but may be any member as long as the member is conductive and has a portion in contact with the ink in the recording head 2. Further, although the structure in which the voltage detecting circuit 36 which detects the change in electrical characteristic is electrically connected to the electrode member 38 of the cap member 33 is exemplified in the above embodiment, the voltage detecting circuit may be connected to the conductive portion of the recording head.

Still further, it is exemplified in the above embodiment that the ink temperature estimating processing is performed using the discharge detecting device and the same procedure as the discharge detecting routine performed in the discharge detecting device, but the invention is not limited thereto. That is, the ink temperature estimating processing may be performed in any form as long as it is performed in a manner such that electrical change information is acquired by detecting the electrical change between the conductive portion and the liquid receiving portion, the correlations between the electrical changes and the temperatures of the liquid discharged from the nozzle orifice 13 are preliminarily stored as correlation information, and the temperature of the liquid corresponding to the electrical change information is estimated as the estimated liquid temperature on the correlation information. The electrical change information in the invention is not limited to the detection voltage detected by the discharge detecting device but may be any kind of electrical change information which can be used to estimate the estimated ink temperature. In the embodiment, although the correlation that the detection voltage rises when the temperature rises is shown, the invention is not limited to such a correlation. That is, it is sufficient that the temperature and the detection voltage are in predetermined correlation and the temperature and the detection voltage match one to one in a temperature range that can be considered in the use of the liquid discharging device.

In the above embodiment, a so-called vertical vibration mode piezoelectric element 19 is exemplified as the discharge driver portion of the invention, but the invention is not limited thereto. For example, the piezoelectric elements 19 may be provided corresponding to the pressure generating chamber 16, respectively, like so-called deflection vibration mode piezoelectric elements 19. Further, without limitation to the piezoelectric element 19, other kinds of discharge drivers such as thermal elements can be used.

The invention can be applied to other liquid discharging devices as well as the printer. For example, the invention may be applied to a display manufacturing device, an electrode manufacturing device, and a chip manufacturing device.

What is claimed is:

1. A liquid discharging device comprising:

a liquid discharging head which discharges liquid from nozzle orifices by being driven by a discharge driver;

a drive signal generator which generates a drive pulse for driving the discharge driver;

a liquid receiving portion which is placed so as to face a nozzle-formed surface of the liquid discharging head and receives liquid discharged from the nozzle orifices;

an electrical change detector which acquires electrical change information by detecting change in an electrical characteristic between a conductive portion of the liquid discharging head and the liquid receiving portion when liquid is discharged from the nozzle orifices to the liquid receiving portion in a state in which a voltage is applied between the conductive portion and the liquid receiving portion; and a correlation information storing portion which stores correlation information which shows correlation between the electrical change information and temperatures of liquid discharged from the nozzle orifices, wherein the drive signal generator generates an information acquiring drive pulse used in electrical change information acquiring processing performed by the electrical change detector, wherein the correlation information which shows correlation between the electrical change information obtained when discharging the liquid using the information acquiring drive pulse and the temperatures of the liquid is preliminarily stored in the correlation information storing portion, and wherein, on the basis of the correlation information, the temperature of the liquid corresponding to the electrical change information obtained in the electrical change information acquiring processing is estimated as an estimated liquid temperature and the drive pulse is corrected according to the estimated liquid temperature.

2. The liquid discharging device according to claim 1, wherein the drive pulse corrected according to the estimated liquid temperature is a discharge drive pulse used when discharging liquid to a discharge target other than the liquid receiving portion.

3. The liquid discharging device according to claim 2, wherein the liquid discharging head moves in a reciprocating manner and discharges liquid in both forward and backward movements, and discharge timing of liquid is adjusted at least in either the forward movement or in the backward movement by correcting drive timing of the discharge drive pulse according to the estimated liquid temperature.

4. The liquid discharge device according to claim 1, wherein the electrical change detector serves as a discharge detector which checks presence of discharge of the liquid from the nozzle orifice by detecting electrical change between the conductive portion of the liquid discharging head and the liquid receiving portion when the liquid is discharged from the nozzle orifice to the liquid receiving portion in a state in which a voltage is applied between the conductive portion and the liquid receiving portion.

5. A method of controlling a liquid discharging device which discharges liquid from nozzle orifices of a liquid discharging head by driving a discharge driver by a drive pulse, the method comprising:

placing a liquid receiving portion which receives liquid discharged from the nozzle orifices so as to face a nozzle-formed surface of the liquid discharging head;

acquiring electrical change information by detecting change in electrical characteristics between a conductive portion of the liquid discharging head and the liquid receiving portion when liquid is discharged from the nozzle orifices to the liquid receiving portion in a state of applying a voltage between the conductive portion and the liquid receiving portion and preliminarily storing correlation between the electrical change information and temperatures of the liquids discharged from the nozzle orifices as correlation information; and estimating a temperature of the liquid corresponding to the electrical change information as an estimated liquid temperature on the basis of the correlation information and correcting a drive pulse according to the estimated liquid temperature.

6. The method of controlling a liquid discharging device according to claim 5, wherein the drive pulse corrected according to the estimated liquid temperature is used as a discharge drive pulse used when discharging liquid to a discharge target other than the liquid receiving portion.

7. The method of controlling a liquid discharging device according to claim 6, wherein the liquid discharging head is made to move in a reciprocating manner and discharge liquid in both forward and backward movements, and discharge timing of liquid is adjusted at least in either the forward movement or the backward movement by correcting drive timing of the discharge drive pulse according to the estimated liquid temperature.

8. The method of controlling a liquid discharging device according to claim 5, wherein the presence of the discharge of liquid from the nozzle orifice can be checked by detecting electrical change between the conductive portion of the liquid discharging head and the liquid receiving portion when the liquid is discharged from the nozzle orifice to the liquid receiving portion in the state of applying a voltage between the conductive portion and the liquid receiving portion.

* * * * *